United States Patent [19]

Lester

[11] Patent Number: 4,776,380

[45] Date of Patent: Oct. 11, 1988

[54] COLLAPSIBLE BLIND FOR SEMI-CIRCULAR ARCHED WINDOW

[76] Inventor: Lance Lester, 9509 N. 13 St., Phoenix, Ariz. 85020

[21] Appl. No.: 74,615

[22] Filed: Jul. 17, 1987

Related U.S. Application Data

[63] Continuation-in-part of Ser. No. 861,923, May 12, 1986, Pat. No. 4,699,195.

[51] Int. Cl.[4] ..... E06B 3/92

[52] U.S. Cl. ..... 160/134

[58] Field of Search ..... 160/134, 166 R, 130, 160/DIG. 3; 296/97 C, 97 G

[56] References Cited

U.S. PATENT DOCUMENTS

| | | | |
|---|---|---|---|
| 602,967 | 4/1898 | Wells | 160/134 |
| 1,447,189 | 3/1923 | Simon | 160/134 X |
| 1,450,142 | 3/1923 | Dietrich | 160/134 X |
| 1,510,984 | 10/1924 | Dorsey et al. | 296/97 G |
| 1,609,877 | 12/1926 | Kendall | 160/134 X |
| 1,617,981 | 2/1927 | Allen | 296/97 G |
| 2,517,281 | 8/1950 | Brown | 160/134 X |
| 3,298,422 | 1/1967 | Ruiz | 160/134 X |
| 4,332,414 | 6/1982 | Surtin | 296/97 G |
| 4,606,572 | 8/1986 | Maguire | 160/DIG. 3 |
| 4,699,195 | 10/1987 | Lester | 160/134 |

*Primary Examiner*—Ramon S. Britts
*Assistant Examiner*—David M. Purol
*Attorney, Agent, or Firm*—Henry M. Bissell

[57] ABSTRACT

A blind for installation adjacent or inside the semi-circular portion of an arched window is disclosed which is based on a U-shaped frame, which frame is adapted for mounting along the face of the window or at the bottom of the semi-circular portion thereof. Two sets of blades fan out evenly from the ends of the U-shaped frame around an axis and meet at the top of the window, thereby forming a semi-circular array. In one embodiment handles rotating from the blade axis are fastened onto the last blade in each set, and meet at the top where they are locked into position by latches mounted on the end of a support arm also rotating from the blade axis. In another embodiment the sets of blades are secured in their open position by fastening the top two blades together with a fixture attached to the window.

17 Claims, 4 Drawing Sheets

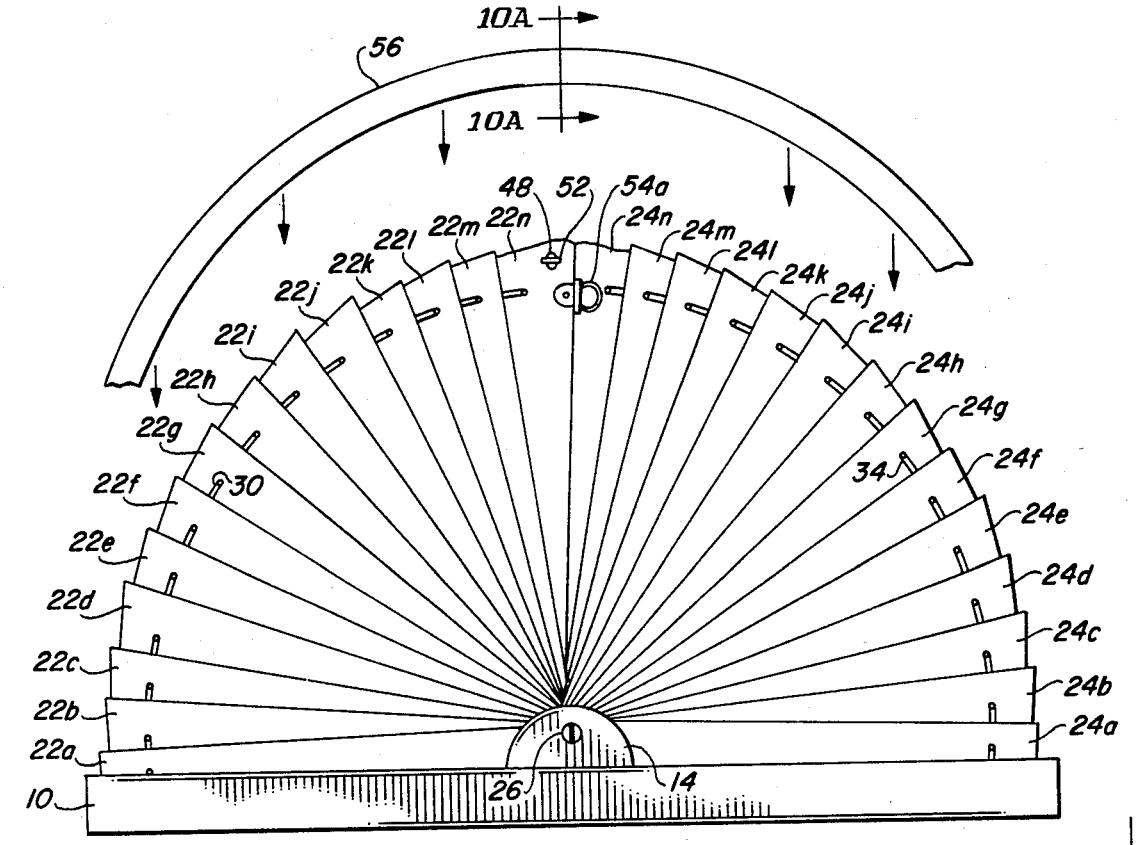
FIG. 10
FIG. 11
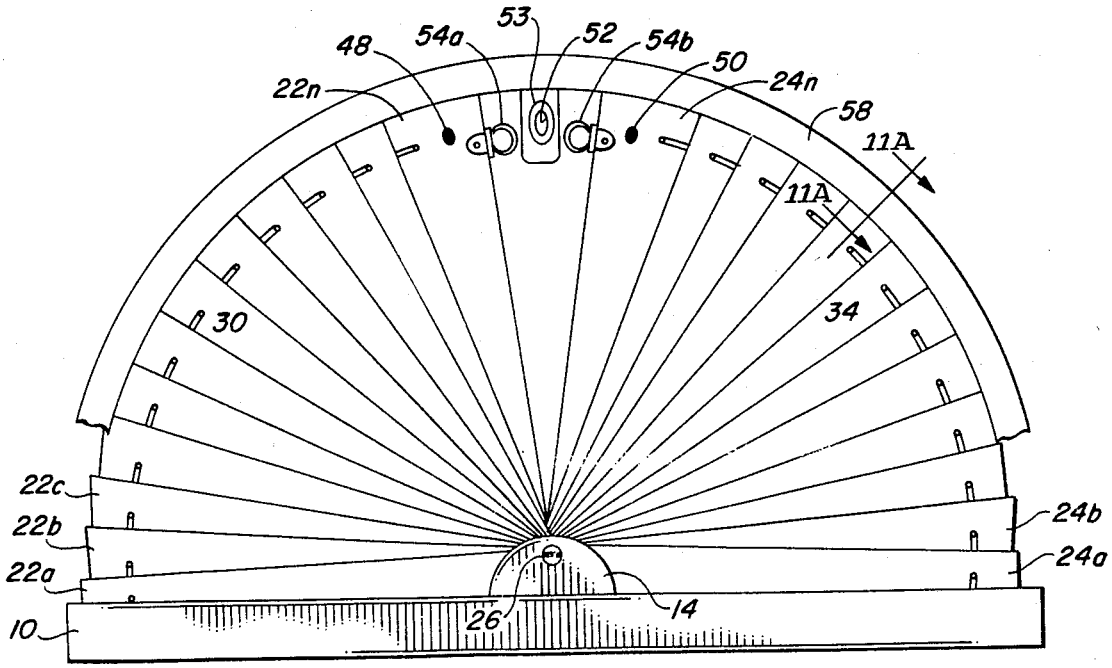

COLLAPSIBLE BLIND FOR SEMI-CIRCULAR ARCHED WINDOW

REFERENCE TO RELATED APPLICATION

This is a continuation-in-part of co-pending Application Ser. No. 861,923 by Lance Lester, entitled "Collapsible Blind For Semi-Circular Arched Window", filed May 12, 1986 now U.S. Pat. No. 4,699,195.

BACKGROUND OF THE INVENTION

1. Field of the Invention

The present invention relates generally to a blind for use in windows to prevent direct sunlight from passing therethrough and, more particularly, to a collapsible blind for convenient installation in a semi-circular arched window, which blind may be easily unfolded and set up to present an attractive and functional window dressing.

2. Description of the Prior Art

Venetian blinds have been in use for some time to prevent direct sunlight from entering a house or other building, while allowing the entrance of sufficient light to fully illuminate the interior of the building, as well as to assure privacy of those within a room from the sight of a person outside who might try to look in. Venetian blinds are typically made of a plurality of parallel rectangular slats or blades, each of which is supported by one of the rungs of a ladder-shaped fabric segment installed at each end of the blades. By raising one side of each of the ladder-shaped fabric segments, the blades may all be simultaneously adjusted to prevent the passage of direct sunlight while allowing a variable amount of indirect light to pass therethrough.

Due to the design of such blinds, they are limited to an essentially rectangular configuration. With the popularity of the Victorian style house at the turn of the century, and the art deco style of the twenties, arched windows were a popular choice in construction. With the prevalence of such windows came the desire to cover them, at least to prevent the passage of direct sunlight therethrough. While the lower rectangular portion could easily and conveniently be covered by standard blinds or shades, the upper semi-circular portion of the arched window was not so easily covered.

With the renewed popularity of both Victorian and art deco architecture, the arched window has come back into style. With the increase in popularity of the arched window has come a substantial demand for a blind designed to fit the semi-circular arched portion of the window.

As might be expected, a number of solutions to the problem were invented during the arched window's earlier popularity, with one of the earliest examples being U.S. Pat. No. 602,967, to Wells. Wells discloses a complex and ambitious device designed to operate in a substantially similar manner to Venetian blinds, with sets of fan-like blades on both sides rising to meet in the center. The complexity of the Wells device makes it difficult and expensive to manufacture, as well as difficult to operate. In addition, since the Wells blind has two sets of blades mounted on different pivot points, and a continuous band around the edge, it is not graceful in appearance and would be difficult to market successfully today.

Other attempts to provide window dressing for an arched window were mainly shades rather than blinds. Examples of such shades are found in U.S. Pat. No. 1,447,189, to Simon, and U.S. Pat. No. 1,609,877, to Kendall. Unfortunately, shades typically allow only diffused light to pass therethrough, and are therefore undesirable to those who only wish to inhibit the passage of direct sunlight through the windows. For this reason, blinds represent a highly desirable solution while shades represent only a partial solution at best.

It may thus be seen that it is desirable to have a semi-circular blind which may be used for arched windows. It is also desirable that the blind be of a relatively simple mechanical design, therefore not presenting the substantial disadvantages of the Wells blind.

It has been established that most people would not even change the position of a blind covering the arched portion of a window, but rather would place the blind in a position which blocks direct sunlight. Therefore, it is only necessary that a blind for the semi-circular portion of an arched window have one position--namely the position preventing the entry of direct sunlight. Accordingly, it is an object of the present invention to provide a substantially fixed blind for use with the semi-circular portion of an arched window.

It is also desirable that the invention be mounted about a single pivot point for aesthetic enhancement and simplicity in operation. The invention should also be easilly installable, without substantial difficulty or the requirement of other than simple hand tools. Finally, it is desirable that the present invention be as inexpensive as possible while solving the aforementioned problems, and that it provide no substantial disadvantages when used.

SUMMARY OF THE INVENTION

The present invention represents an advantageous solution to the problems mentioned above. A frame is provided for mounting into the arched window at the bottom of the semi-circular portion of the window. The frame supports a plurality of blades which fan out from a common axis of rotation. Half of the blades fan out from one end of the frame, and the other half of the blades fan out from the other end of the frame, with the blades meeting at the top of the semi-circular portion of the arched window. Each group of blades is connected near the end opposite the axis of rotation in sequence to a cord, tape or ribbon allowing an identical separation of the blades.

Each set of half of the blades has a handle connected to the blade farthest from the end of the frame from which the blades fan out. The handles are also rotatably mounted around the same axis and at the front of the blind, with the end of the handle away from the axis of rotation being connected to the end of the last blade away from the axis of rotation. A pair of latches is mounted on the end of a support arm extending form the same axis at the back of the blind. The ends of the handles away from the axis of rotation are secured to the latches in the support arm, completing the assembly of the blind. Alternatively, the latches may be mounted on the wall at the top of the window for retaining the blind in the closed position.

In an alternative embodiment, hinged rings are provided to replace the handles and slotted holes are provided in the two top blades to allow their being fastened together. A semi-circular guide channel strip is mounted just inside the window opening, and the outer ends of the fanned out blades are kept within the channel provided.

The blades may also have a variable degree of twist therein, depending on the amount of light the blind is to admit. By twist, it is meant that the edge of the blade at one end is angularly displaced from the edge at the other end of the blade. If the blades have little or no twist along their length they will admit virtually no light. On the other hand, if they have a great amount of twist, they will admit an amount of light proportionate to the degree of twist therein. The twist may be substantially at one location near the end of the blades fastened to the bolt, or it may be gradual along the length of the blade.

It will be appreciated that the blind of the present invention advantageously satisfies the objectives enumerated above, and with no substantial disadvantage whatsoever. The blind may be shipped in a collapsed position, and easily brought to its assembled position without the need for any tools whatsoever. In fact, the only need for a tool is for a screwdriver to fasten the mounting brackets to the window casing.

The blind of the present invention neatly fits the semi-circular arched window shape, and effectively prevents the passage of direct sunlight therethrough. Due to the construction of the present invention, it may be appreciated that it is relatively inexpensive to manufacture, and that it presents no difficult mechanical operation which would require particularly close tolerances. Finally, and notably as far as marketing such a blind is concerned, its single pivot point renders the assembled and installed blind aesthetically pleasing, making it a desirable accessory for arched windows.

DESCRIPTION OF THE DRAWINGS

A better understanding of the present invention may be realized from a consideration of the following detailed description, taken in conjunction with the accompanying drawings in which.

DETAILED DESCRIPTION OF THE PREFERRED EMBODIMENTS

Figure 2:
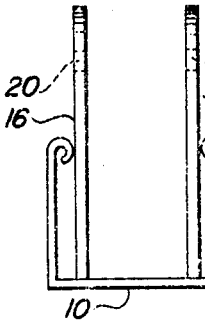
FIG. 2 is an end view of the U-shaped channel and the two support pieces illustrated in FIG. 1.
Figure 1:
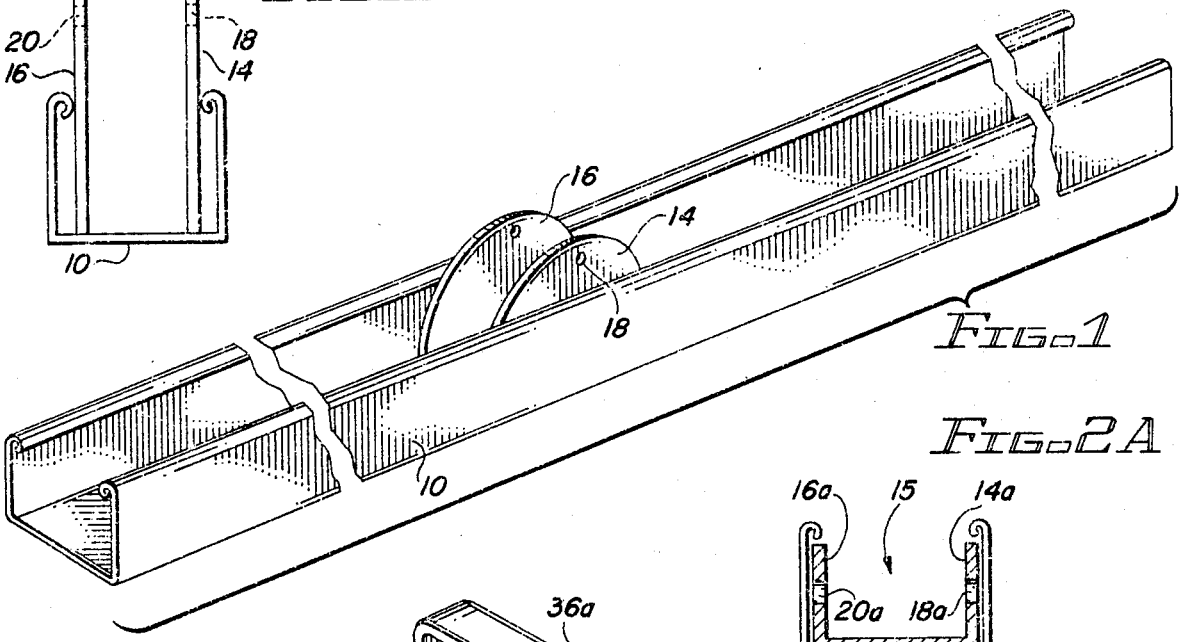
FIG. 1 is a perspective view of the U-shaped channel frame and the two support pieces mounted thereon.
Figure 3:
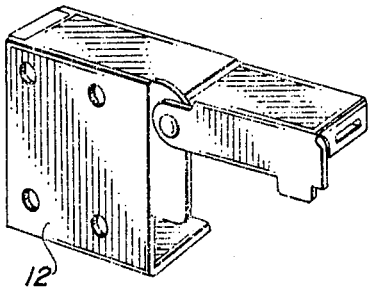
FIG. 3 is a perspective view of one of the brackets used to mount the U-shaped channel shown in FIGS. 1 and 2 adjacent an arched window casing.

As shown in FIGS. 1 and 2, one embodiment of the present invention uses as a simple frame a segment of standard two-inch by two-inch U-shaped steel channel 10 which will be mounted at the bottom of the semi-circular portion of an arched window with the open side of the U-shaped channel 10 facing upward. The U-shaped channel 10 is mounted to the window casing (not shown) using a pair of standard blind support brackets, the installation of which is well known. One of the brackets 12 is shown in FIG. 3. Referring again to FIG. 1, the length of the U-shaped channel 10 will of course depend on the size of the window the blind is to be installed in, with the length of the U-shaped channel 10 usually being slightly greater than the diameter of the semi-circular portion of the arched window for installation on the face of the wall in which the window is positioned.

The semi-circular support pieces 14, 16 made of steel are installed in the interior of the U-shaped channel 10 at the center thereof, with one support piece 14 mounted on the interior of the front side of the U-shaped channel 10 and extending therefrom, and the other support piece 16 mounted on the interior of the back side of the U-shaped channel 10. The support pieces 14, 16 are thus parallel to each other and centrally located in the U-shaped channel 10, and have a space therebetween and partially within the U-shaped channel 10, as best shown in FIG. 2.

Figure 2A:
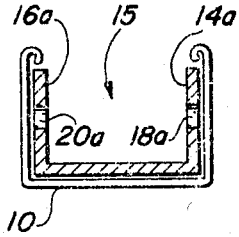
FIG. 2A shows an alternative to the arrangement of FIG. 2.

The support pieces 14, 16 are approximately semi-circular in shape in the preferred embodiment, with the shape being essentially a pleasing or aesthetic configuration when viewed with the rest of the device when installed in a window. The support pieces 14, 16 have apertures 18, 20, respectively, therethrough, with the apertures 18 and 20 being axially aligned and defining an axis of rotation. Alternatively, as shown in FIG. 2A, the pieces **14*a*, 16*a* may comprise the side portions of a U-shaped member or hub 15 which is situated within the channel 10, thereby providing structural reinforcement to the channel, and having apertures 18*a* and 20*a* recessed below the upper edges of the channel 10**.

Figure 6:
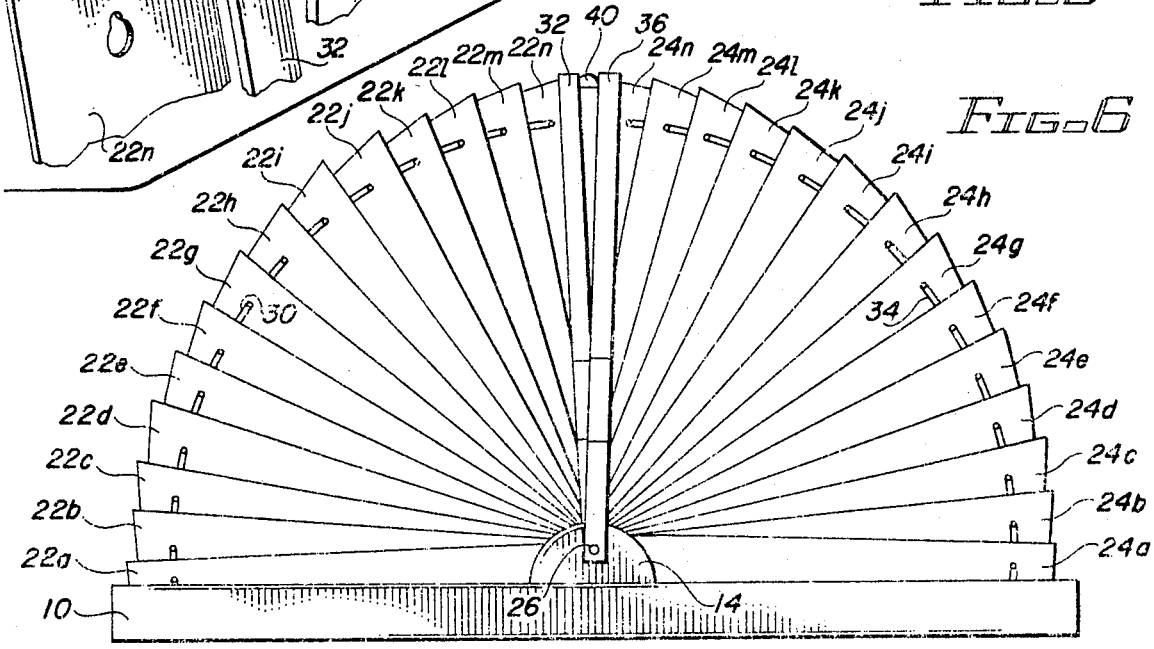
FIG. 6 is a front view of the blind of FIG. 5 in an open and locked position.
Figure 5:
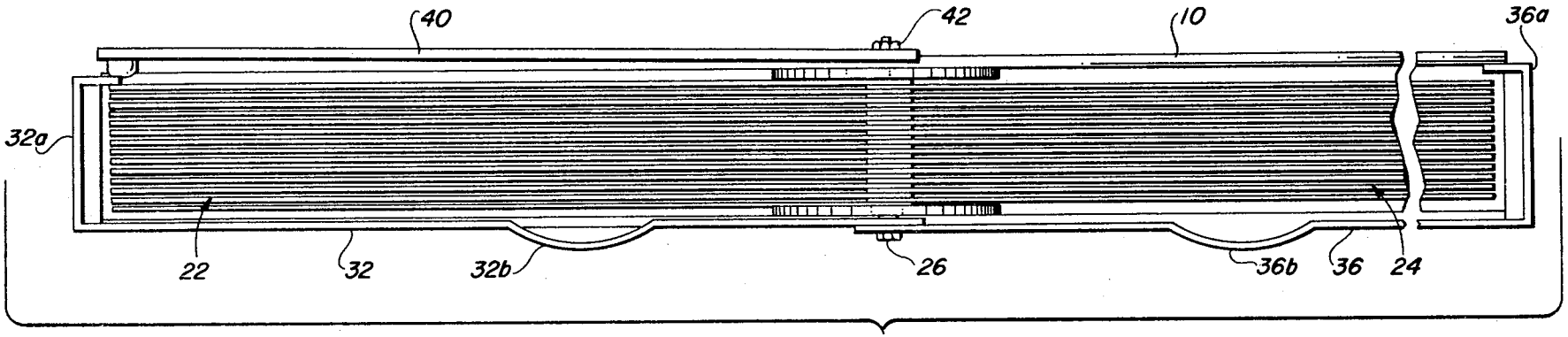
FIG. 5 is a top view of the blind of the present invention in an unopened position.

As shown in FIGS. 5 and 6, two sets of blades 22, 24 are movably mounted between the support portions 14, 16 by a pivot member in the form of a bolt 26 passing through one end of each blade in the first and second sets of the blades 22, 24 and the apertures 18, 20 in the support portions 14, 16. All of the blades in the first and second sets of blades 22, 24 are thereby mounted between the support portions 14, 16, with successive blades going alternatively toward one end or the other of the U-shaped channel 10. The blades are typically made of metal such as steel or aluminum. They could also be made of plastic.

In the embodiment shown in these figures, each of the two sets of blades 22, 24 contains 14 individual blades. The first set of blades 22, which are located on the left side of the U-shaped channel 10, includes blades **22*a*–22*n*, and the second set of blades 24, which are located on the right side of the U-shaped channel 10, includes blades 24a–24n. It will, of course, be recognized that different numbers of blades could be included in the first and second sets of blades 22, 24**, without departing from the spirit of the invention. Larger size windows may require more blades, while smaller windows can be served with fewer blades.

Figure 4:
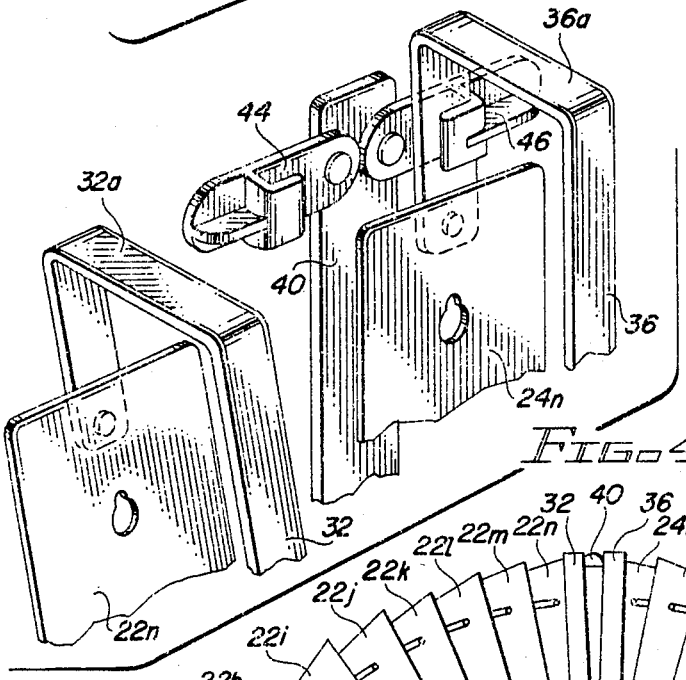
FIG. 4 is a partial perspective view of the ends of the handles used to bring the blades into position, the support arm, and the latches on the support arm used to secure the handles and the blades in an open position for one embodiment of the invention.
Figure 7:
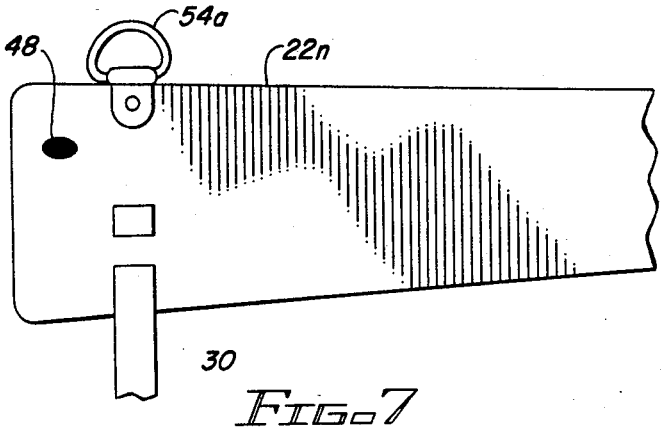
FIG. 7 is a plan view of the last blade in the first set of blades in an alternative embodiment.

The blades in the two sets of blades 22, 24 are mounted on the bolt 26 in alternating sequence between the support portions 14, 16, in the order 24a, 22a, 24b, 22b, 24c, 22c, etc. The blades in the first set of blades 22 are fastened together with a first length of ribbon or tape 30 such that there are equal distances between successive blades in the first set of blades 22, with the blade 22a at the front of the blind being fastened to the U-shaped channel 10 by the tape 30 or by other means known in the art. The use of the tape 30 is as known in the art to separate succeeding blades by a desired distance, and the blades typically contain two adjacent differing size holes such as those shown in the blades 22n and 24n in FIG. 4. The tape 30 is connected to the blades typically by light rivets, such as are used in leather work. In an alternative embodiment, the tape can be fastened to each blade by threading the tape through three parallel slits and crimping the metal between two successive slits (as shown in FIG. 7).

Figure 8:
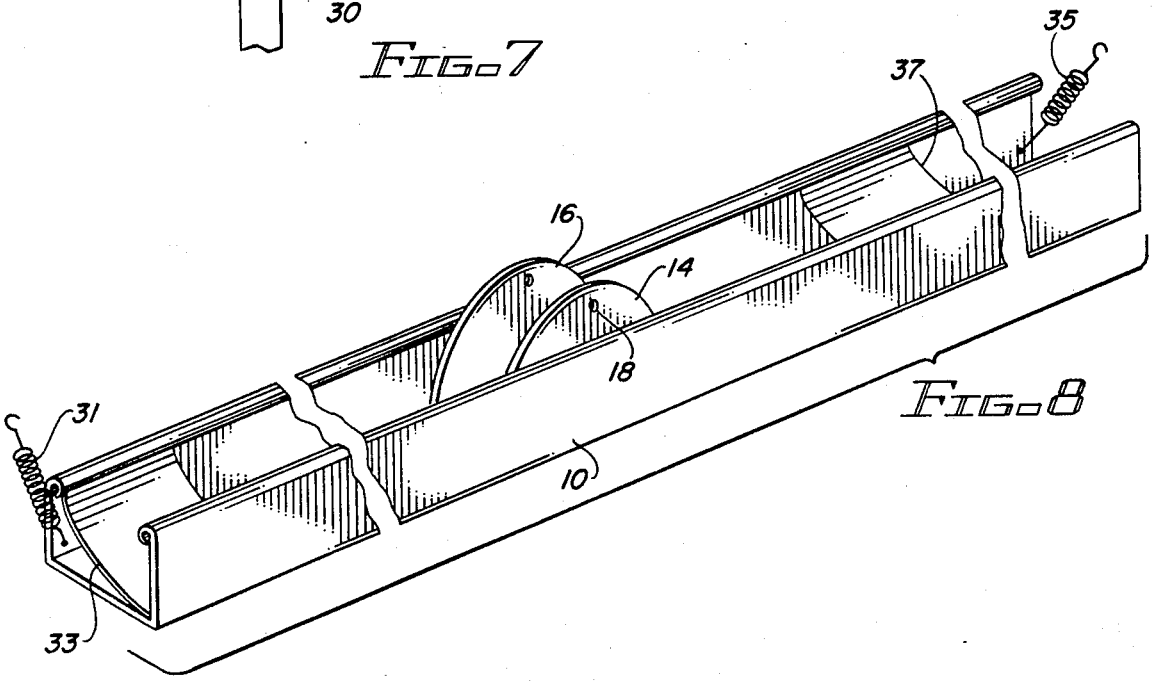
FIG. 8 is a perspective view of the U-shaped channel frame showing the tensioning springs and one of the guide blades in an alternative embodiment.

The blades in the first set of blades 22 may thus fan out evenly, with the last blade 22n reaching a position approximately 90° from the left end of the U-shaped channel 10 with the tape 30 drawn tight between the blades in the first set of blades 22. In an alternative embodiment (as shown in FIG. 8), a means of tensioning the tape 30 may be employed, such as the simple helical tensioning spring 31. Spring 31 is attached at one of its ends to the back side of U-shaped channel 10, and at the other of its ends to one of the lower blades such as 22b or 22c. The last blade 22n has its end away from the axis of rotation fastened to a handle 32 which also rotates about the bolt 26. The handle 32 has a U-shaped segment 32a at the end removed from the axis of rotation, which U-shaped segment 32a goes around the blades in the first set of blades 22 to reach the back side of the last blade 22n at the end of the last blade 22n away from the axis of rotation. The handle 32 is then riveted to the end of the last blade 22n at the point of contact.

It may thus be appreciated that when the first set of blades 22 is collapsed into the left side of the U-shaped channel 10 as shown in FIG. 5, by moving the handle 32 in a clockwise direction the first set of blades 22 is fanned out evenly. The handle 32 contains a grip portion 32b which may be conveniently gripped without contacting the blades in the first set of blades 22.

Figure 9:
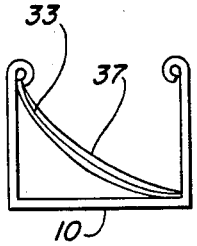
FIG. 9 is an end view of the U-shaped channel showing the two guide blades installed in the interior of the channel.

In an alternative embodiment, a curved guide blade 33 is used to keep the folded blades 22a–22n together in the front part of U-shaped channel 10 (see FIGS. 8 and 9).

Likewise, the blades in the second set of blades 24 are fastened together with a second length of tape 34 such that there are equal distances between successive blades in the second set of blades 24, with the blade 24a at the front of the blind being fastened to the U-shaped channel 10. The tape 34 functions as does the tape 30 to separate succeeding blades in the second set of blades 24 by a desired distance. Corresponding to the tensioning spring 31 for the first set of blades 22a–22n, a tensioning spring 35 keeps tape 34 under tension for the second set of blades 24a–24n. One end of spring 35 is attached to the back side of the U-shaped channel 10 at its right end and the other end of spring 35 is attached to one of the lower blades such as 24b or 24c. The tapes 30, 34 preferably comprise lengths of flat webbing about $\frac{3}{8}$ inch wide.

The blades in the second set of blades 24 may thus also fan out evenly, with the last blade 24n reaching a position approximately 90° from the right end of the U-shaped channel 10 with the tape 34 drawn tight between the blades in the second set of blades 24. The last blade 24n has its end away from the axis of rotation fastened to a handle 36 which also rotates about the bolt 26. The handle 36 has a U-shaped segment 36a at the end removed from the axis of rotation, which U-shaped segment 36a goes around the blades in the second set of blades 24 to reach to the back side of the last blade 24n at the end of the last blade 24n away from the axis of rotation. The handle 36 is then riveted to the end of the last blade 24n at the point of contact.

The second set of blades 24 is collapsed into the right side of the U-shaped channel 10 as shown in FIG. 5, and by moving the handle 36 in a counterclockwise direction the second set of blades 24 is fanned out evenly. The handle 36 also contains a grip portion 36b which may be conveniently gripped without contacting the blades in the second set of blades 24.

A curved guide blade 37 in the U-shaped channel 10 near its right-hand end functions similarly to curved guide blade 33. Guide blades 33 and 37 are both made of the same material as blades 22a–22n and 24a–24n. The upper end of each guide blade is retained under the lip of the back side of U-shaped channel 10, and the lower end of each guide blade abuts the front bottom corner of the U-shaped channel 10.

A support arm 40 is also rotatably mounted on said bolt as it passes through the hole 20 in back support portion 16, and the bolt is secured with a nut 42. A pair of latches 44, 46 are fastened to the support arm 40 at the end away from the axis of rotation. The latch 44 extends to the left side of the support arm 40 when the support arm 40 is directed at a 90° angle from the U-shaped channel 10, and the latch 46 extends to the right side of the support arm 40.

The U-shaped portion 32a of the handle 32 may be secured into the latch 44 by slightly stretching the tape 30, which will by tension therein retain the U-shaped portion 32a in the latch 44. Likewise, the U-shaped portion 36a of the handle 36 may be secured into the latch 46 by slightly stretching the tape 34, which will by tension therein retain the U-shaped portion 36a in the latch 46, completing assembly of the device.

Figure 10A:
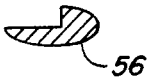
FIG. 10 is a front view of an alternative embodiment of the blind in an open and locked position, FIG. 10A being a sectional view taken along the line A—A of FIG. 10.

In an alternative embodiment shown in FIG. 10, handles 32 and 36 and latches 44 and 46 can be dispensed with. Instead, slotted holes 48 and 50 can be made in blades 22n and 24n, respectively, and the invention can be fixed in its deployed position by passing, through slots 48 and 50, a rotatable part 52 of a conventional fastening device 53 mounted in the window opening at its center. Part 52 is rotated through half a turn to secure blades 22n and 24n in place. In this alternative embodiment hinged rings 54a and 54b are attached to blades 22n and 24n, respectively. Rings 54a and 54b provide a means of grasping and holding blades 22n and 24n in such a position that slotted holes 48 and 50 overlap. Part 52 can then be inserted through slotted holes 48 and 50 to fasten the blades together as described above.

The various components of the blind disclosed herein may be painted prior to assembly. As may be apparent, the blind is shipped collapsed as shown in FIG. 5. The blades of the device may be relatively flat, and if so, the blind will let relatively little light, direct or indirect, pass therethrough. The blades may, however, have a variable degree of twist therein depending on the amount of light the blind is to admit. The twist enables the edge of the blades at one end to be angularly displaced from the edge at the other end of the blades. If the blades have little or no twist along their length they will admit virtually no light. On the other hand, if they have a great amount of twist, they will admit a quantity of light proportionate to the degree of twist therein. The twist may be substantially at one location near the end of the blades fastened to the bolt 26, or it may be gradual along the length of the blades, depending on the particular effect desired.

If the blades **22*a*–22*n* and 24*a*–24*n*** are made of a translucent material, e.g., a translucent plastic, light can be admitted by the blind even if there is no twist to the blades. A pleasing effect of colored light coming through the blind can be obtained by fabricating the blades from colored translucent plastic. Striking effects might be achieved by the use of more than one color.

The device as disclosed above provides significant advantages with no relative disadvantage at all. The blind may be shipped collapsed, and easily brought to its assembled position without the use of tools. Only a screwdriver is needed to fasten the mounting brackets to the window casing. In one embodiment the blind of the present invention neatly fits along the face of the semi-circular arched window shape, and effectively prevents the passage of direct sunlight therethrough. In this case an additional advantageous feature can be gained by attaching a plastic molding strip 56 along the semi-circular edge of the window opening to keep the blind blades from rubbing against the wall they overlap (see FIG. 10).

Figure 11A:
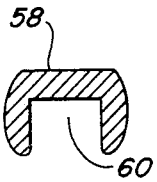
FIG. 11 is a front view of an alternative embodiment of the blind employing a guide channel strip, FIG. 11A being a sectional view taken along the line B—B of FIG. 11.

In an alternative embodiment shown in FIG. 11, a guide channel strip 58 can be mounted just inside the window opening along its semi-circular cylindrical surface. The outer blade ends of sets **22*a*–22*n* and 24*a*–24*n* are then kept within the channel 60** provided and the blind can be installed inside the window opening. All embodiments described herein are relatively inexpensive to manufacture, and present no difficult mechanical operations which would require particularly close tolerances. Also, the single pivot point common to all embodiments renders the assembled and installed blind aesthetically pleasing, making it a desirable accessory for arched windows.

Figure 12:
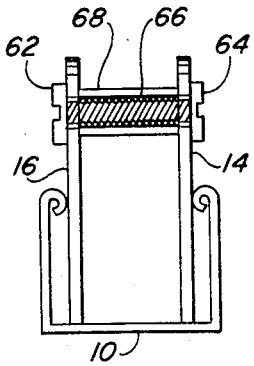
FIG. 12 is a sectional end view of the U-shaped channel frame and the two support pieces with an alternative embodiment of the pivot member.

As shown in FIG. 12, the pivot member 26 may be constructed as follows in an alternative embodiment. Slotted heads 62 and 64 screw onto the threaded ends of a stud 66. A cylindrical sleeve 68 fits over stud 66 and the tapped parts of slotted heads 62, 64 during assembly. The slots in slotted heads 62 and 64 can be made wide enough so that a small coin can conveniently be used to turn them in the absence of a screwdriver.

Although there have been described above specific arrangements of an improved collapsible blind for semi-circular arched window in accordance with the invention for the purpose of illustrating the manner in which the invention may be used to advantage, it will be appreciated that the invention is not limited thereto. Accordingly, any and all modifications, variations or equivalent arrangements which may occur to those skilled in the art should be considered to be within the scope of the invention as defined in the annexed claims.

What is claimed is:

1. A collapsible blind for use with an arched window opening in a wall, said opening having a semi-circular portion at the top thereof, comprising:

a U-shaped channel at the bottom of said semi-circular portion with the open side of said U-shaped channel facing upward, said U-shaped channel thereby having a front side facing the interior of said wall and a back side facing the exterior of said wall, and said U-shaped channel further having a first support portion on one side thereof and at the center thereof, said first support portion having an aperture therethrough, and a second support portion on the back side thereof and at the center thereof, said second support portion having an aperture therethrough, said first and second support portions having a space therebetween, and said apertures defining an axis of rotation;

a pivot member extending through said apertures in said first and second support portions;

a first set of blades each having an aperture at one end thereof for mounting on said pivot member between said first and second support portions, the blade in said first set of blades closest to said first support portion being said first blade in said first set of blades, the blade in said first set of blades closest to said second support portion being said last blade in said first set of blades, said last blade of said first set having a slotted hole therethrough close to an end furthest away from said pivot member;

a first tape extending between successive ones of said first set of blades for allowing said first set of blades to fan out, said first blade in said first set of blades being attached to said U-shaped channel at one end thereof, said last blade in said first set of blades being approximately 90° away from said one end of said U-shaped channel when said first set of blades are fanned out;

first means for tensioning said first tape, attached between said U-shaped channel and one of said first set of blades;

a second set of blades each having an aperture at one end thereof for mounting on said pivot member between said first and second support portions, the blade in said second set of blades closest to said first support portion being said first blade in said second set of blades, the blade in said second set of blades closest to said second support portion being said last blade in said second set of blades, said last blade of said second set having a slotted hole therethrough close to an end furthest away from said pivot member;

a second tape extending between successive ones of said second set of blades for allowing said second set of blades to fan out, said first blade in said second set of blades being attached to said U-shaped channel at the other end thereof, said last blade in said second set of blades being approximately 90°0 away from said other end of said U-shaped channel when said second set of blades are fanned out;

second means for tensioning said second tape, attached between said U-shaped channel and one of said blades of said second set:

first means for moving said first set of blades from a collapsed position within said one end of said channel to an open position;

second means for moving said second set of blades from a collapsed position within said other end of said channel to an open position;

means for securing said first and second sets of blades in an open position;

restraining means for restraining the range of motion of the fanned-out ends of said first and second sets of blades in a direction transverse to a plane defined by said blades in said open position;

a first curved guide blade in said U-shaped channel near a first end thereof, having a concave upward shape and spanning the distance between the upper back side of said U-shaped channel and the lower front corner of said U-shaped channel, beneath said first and second sets of blades; and a second curved guide blade in said U-shaped channel near a second end thereof, having a concave upward shape and spanning the distance between the upper back side of said U-shaped channel and the lower front corner of said U-shaped channel, beneath said first and second sets of blades; and wherein the blade in said first set of blades closest to said first support portion is the first blade in said first set of blades, the blade in said first set of blades closest to said second support portion is the last blade in said first set of blades, the blade in said second set of blades closest to said first support portion is the first blade in said second set of blades, and the blade in said second set of blades closest to said second support portion is the last blade in said second set of blades, said first blade in said first set of blades is attached to said U-shaped channel at one end thereof, and said first blade in said second set of blades is attached to said U-shaped channel at the other end thereof.

2. A collapsible blind as defined in claim 1 further comprising:

a first support piece installed in the interior of said U-shaped channel on one side thereof and at the center thereof, said first support piece having an aperture therethrough, and a second support piece on the other side thereof and at the center thereof, said second support piece having an aperture therethrough, said first and second support pieces defining a space therebetween, and said apertures defining an axis of rotation.

3. A collapsible blind as defined in claim 1 wherein said U-shaped channel is mounted to said window using a pair of standard blind support brackets.

4. A collapsible blind as defined in claim 1 wherein said blades are made of a metal from the group consisting steel and aluminum.

5. A collapsible blind as defined in claim 1 wherein said blades are made of a plastic material.

6. A collapsible blind as defined in claim 1 wherein said first blade in said first set of blades is attached to said U-shaped channel at said one end thereof by said first tape, and said first blade in said second set of blades is attached to said U-shaped channel at the other end thereof by said second tape.

7. A collapsible blind as defined in claim 1 wherein said first blade of said first set of blades is adhesively affixed to said U-shaped channel at said one end thereof, and said first blade of said second set of blades is adhesively affixed to said U-shaped channel at the other end thereof.

8. A collapsible blind as defined in claim 1 wherein each blade of said first set of blades has two or more parallel slits therein, said first tape being threaded through said slits and a portion of said blade between two adjacent slits being crimped to hold said first tape in place; and wherein each said blade of said second set of blades has two or more parallel slits therein, said second tape being threaded through said slits and a portion of said blade between two adjacent said slits being crimped to hold said second tape in place.

9. A collapsible blind as defined in claim 1 wherein said first and second tensioning means both comprise helical springs.

10. A collapsible blind as defined in claim 1 wherein said restraining means comprises a protective molding strip covering the upper front edge of said semi-circular portion of said arched window opening, and said U-shaped channel is mounted along the face of said window opening at the bottom thereof.

11. A collapsible blind as defined in claim 1 wherein said last blade in said first set of blades is approximately 90°0 away from said one end of said U-shaped channel when said first set of blades is fanned out, and said last blade in said second set of blades is approximately 90° away from said other end of said U-shaped channel when said second set of blades is fanned out.

12. A collapsible blind as defined in claim 1 wherein said pivot member comprises:

a threaded stud;

a first slotted head tapped to receive a first end of said threaded stud;

a second slotted head tapped to receive a second end of said threaded stud; and a cylindrical sleeve surrounding said threaded stud.

13. A collapsible blind as defined in claim 1 wherein said first and second means for moving comprise:

first means for grasping and handling, mounted on a front surface of said last blade of said first set of blades, near an end furthest from said pivot member; and second means for grasping and handling, mounted on a front surface of said last blade of said second set of blades, near an end furthest from said pivot member;

and wherein said securing means comprises a rotatable fastening member fixed to said semi-circular portion of said arched window at the top thereof;

wherein said rotatable member can be inserted through said slotted hole in said last blade of said first set of blades and also through said slotted hole in said last blade of said second set of blades, and rotated to secure said first and second sets of blades in open position.

14. A collapsible blind as defined in claim 1 wherein said blades are twisted whereby the edge of the blades at one end are angularly displaced from the edge of the blades at the other end, thereby permitting the blind to admit indirect light.

15. A collapsible blind as defined in claim 1 wherein the blades of said first and second set of blades are installed on said pivot member in alternating fashion, with a blade from said first set of blades being followed by a blade from said second set of blades, and vice versa.

16. A collapsible blind as defined in claim 1 further comprising a U-shaped support member mounted within the U-shaped channel at the center thereof as a stiffener therefor.

17. A collapsible blind as defined in claim 1 in which said restraining means comprises a semi-circular guide channel strip mounted inside said semi-circular portion of said arched window opening, having an open channel facing said pivot member, said channel containing in its interior the ends of said first and second sets of blades furthest away from said pivot member when said first and second sets of blades are fanned out and in which said U-shaped channel is mounted in said window.

* * * * *